United States Patent [19]

Teague, Jr. et al.

[11] 4,175,359

[45] Nov. 27, 1979

[54] FLUID POWERED ORBITAL WET SANDER AND THE LIKE

[76] Inventors: Walter D. Teague, Jr., Tweed Blvd., Nyack, N.Y. 10960; Arthur T. Sempliner, 37-04 Van Nostrand Pl., Douglaston, N.Y. 11363

[21] Appl. No.: 848,806

[22] Filed: Nov. 7, 1977

[51] Int. Cl.[2] ..... B24B 23/00

[52] U.S. Cl. ..... 51/170 MT; 51/267; 51/134.5 F; 173/59; 15/97 R

[58] Field of Search ..... 51/170 MT, 170 R, 267, 51/58, 119, 124 L, 134.5 F; 15/22 R, 22 C, 24, 29, 97 R; 128/45-50; 173/57-59, 73, 79, 77, 168, 169, DIG. 4; 418/49-53

[56] References Cited

U.S. PATENT DOCUMENTS

| | | | |
|---|---|---|---|
| 1,821,394 | 9/1931 | Moschetto . | |
| 2,244,539 | 6/1941 | Krueger | 418/50 |
| 2,270,309 | 1/1942 | Kehle | 51/170 MT |

FOREIGN PATENT DOCUMENTS

| | | | |
|---|---|---|---|
| 2040907 | 2/1971 | Fed. Rep. of Germany | 51/170 MT |

*Primary Examiner*—Robert Louis Spruill
*Assistant Examiner*—Roscoe V. Parker
*Attorney, Agent, or Firm*—Mandeville and Schweitzer

[57] ABSTRACT

A lightweight, portable, fluid-driven orbital wet sander or the like comprising a fluid-driven, nutating action motor including a rod-like output element and a sanding or scrubbing device directly linked to a projecting end of the output element. The nutating action motor is mounted on a plate which includes a gripping element mounted on one side thereof to permit the sander to be easily held by the user. The sanding or scrubbing device is mounted in a spaced relation to the mounting plate by a transversely yieldable support means attached to and projecting from the side of the mounting plate opposite the handle side. The projecting end of the output element extends from the nutating motor through the spacing between the mounting plate and utilization device to a universal joint connection with the utilization device. The motor includes a housing confining a wobble plate which is driven with a nutating action by a controlled flow of fluid (typically water) through the housing. The output element is rigidly secured to the wobble plate and the projecting end is moved in an orbital manner as the wobble plate is driven through its nutating cycle. The sanding or scrubbing device is therefore moved by the output element through an orbital motion to provide a highly effective sanding or cleaning operation. The yieldable support means will yield in the transverse direction to accommodate the orbital motion of the sanding device. All or part of the driving water stream is discharged from the utilization device to the working surface to effect a wet sanding or scrubbing operation.

10 Claims, 2 Drawing Figures

FLUID POWERED ORBITAL WET SANDER AND THE LIKE

RELATED APPLICATIONS

This application is closely related in subject matter to our following co-pending applications, all directed to nutating action devices and improvements thereon: Ser. No. 827,625, filed Aug. 25, 1977, Ser. No. 888,137, filed Mar. 20, 1978; Ser. No. 888,136, filed Mar. 20, 1978; Ser. No. 848,807, filed Nov. 7, 1977 and Ser. No. 911,803, filed June 2, 1978.

BACKGROUND AND SUMMARY OF THE INVENTION

Water powered cleaning and scrubbing appliances are well known in the prior art. Representative, but by no means exhaustive of the patented prior art on such cleaning appliances are the following U.S. Pat. Nos. Cummins, 1,694,733; Haines, 2,599,911; Brucker et al., 3,039,123; Potenza, 3,088,149; Frandsen, 3,431,573; Vivion, 3,760,447; and Guadio, 3,813,721. Typically, in the prior art a scrubbing brush or abrading device is driven in a rotary fashion by a water-driven rotor. For example, in the Potenza U.S. Pat. No. 3,088,149, a disc-shaped abrading element is mounted at the end of a shaft which is rotatably journaled in the body of the device and extends into a fluid flow passage housed within the device. A rotor element is fixedly attached to the end of the shaft within the passage and a controlled flow of water through the passage strikes the radial blades of the rotor element to impart a rotary motion to the shaft thereby rotating the disc-shaped abrading element. Notwithstanding the numerous prior art proposals for water-driven appliances, none of them has provided a completely satisfactory basis for a small, hand-held, household-type appliance.

Accordingly, a principle objective of the Applicant's co-pending application Ser. No. 827,625, filed Aug. 25, 1977, is to provide a novel and improved water-powered appliance or the like, which is capable of highly economical construction, is small and lightweight, and which at the same time operates at an acceptable level of power output and at acceptable efficiencies. In accordance with one of the specific aspects of the invention of said co-pending application, a fluid-driven motion appliance is provided, which utilizes in a novel and unique manner a nutating motor element, which is contained within the appliance housing and is driven by the flow of fluid, typically water from a household source. While nutating motors are, in themselves, well known in the art, the invention of said co-pending application provides unique advantages by utilizing a nutating action motor with a utilization device mounted directly upon the output shaft of the nutating wobble plate. In the operation of the appliance, the utilization device is provided with a generally orbital motion. The utilization device does not, however, rotate about it axis. This provides a highly desirable and effective form of motion. Heretofore, the orbital movement of the output shaft has been used to obtain a rotary output from a shaft journaled on a fixed axis.

As one of its basic objectives, the present invention seeks to provide a novel fluid-driven wet sander or the like which is a modification of the general type of nutating action appliance proposed in said co-pending application and which is useful to particular advantage as a wet sander. Generally, the wet sander appliance of the invention comprises a fluid-driven nutating action motor provided with a housing including a water inlet and outlet, and containing a wobble plate mounted upon a sphere. The sphere is mounted for universal movement relative to the housing, within certain angular limits, and an output device in the form of a shaft or rod extends from the shere, along the axis extending through the center of the wobble plate, at right angles thereto. The wobble plate is slotted at one side and straddles a separating plate which divides the housing in which the wobble plate is contained. The motor housing is supported by a plate which advantageously includes a handle or gripping element.

Pursuant to an important feature of the present invention, the utilization device (typically a sander, brush or scrubbing device) is supported in a spaced relation to the motor housing by a transversely yieldable support means. In a preferred form of the invention, the support means comprises a rubber boot-like structure interconnecting the plate and utilization device. The boot is sufficiently rigid in compression to prevent collapsing of the utilization device against the motor mount plate under normal operating pressures, but at the same time, is sufficiently resilient in the transverse direction to permit movement of the utilization device in its plane. Of course, other support means may be used, for example rubber or coil spring stand offs. The output shaft extends from the motor housing within the confines of the boot and is directly linked to the utilization device by a universal joint means.

In the operation of the device, water flows into the housing on one side of the separating plate, travels in a circular path around the housing, and leaves through the outlet on the opposite side of the separating plate. The wobble plate is held in a tilted position by means of a rotary member engaging the shaft of the wobble plate. Thus, when water is admitted into the housing and travels around it to reach the discharge port, it pushes against the tilted wobble plate which assumes progressively changing tilt angles as a result of continued water flow. The resulting nutating motion of the wobble plate causes the output shaft to move in an orbital manner which is transferred to the utilization device by the universal joint means. To advantage, the transversely yieldable support means will flex to allow the utilization device to be moved through an orbital motion.

Provision is made to discharge all or a portion of the driving water onto the surface being sanded or scrubbed to enhance the operation of the utilization device. This is especially advantageous when the utilization device is a sander, a principle application of the appliance of the present invention, whereby a highly effective wet sanding operation may be performed.

For a more complete understanding of the above and other features and advantages of the invention, reference should be made to the following detailed description of a preferred embodiment and to the accompanying drawings.

DETAILED DESCRIPTION OF A PREFERRED EMBODIMENT

Figure 1:
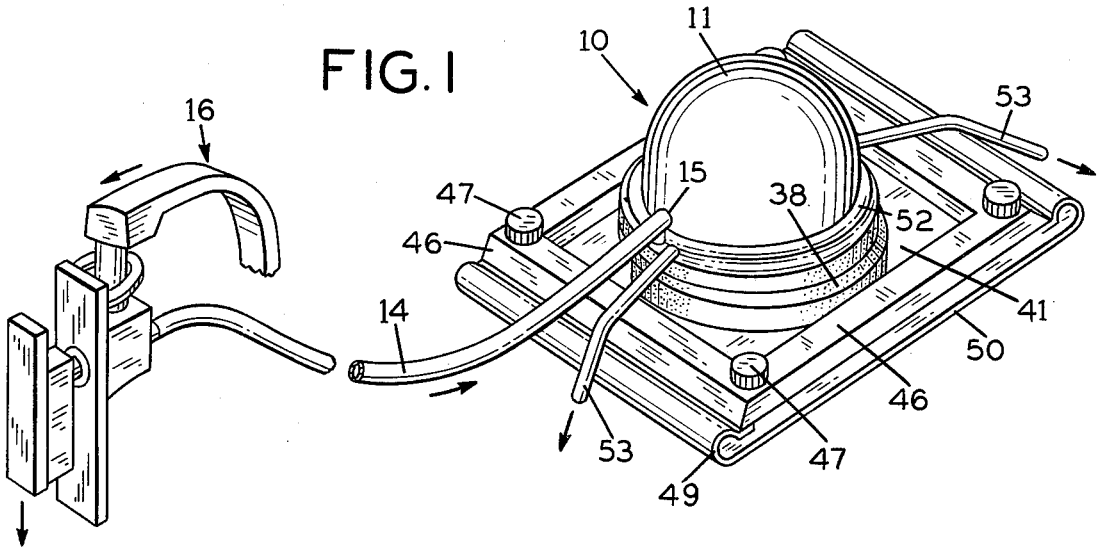
FIG. 1 is a perspective view of an orbital wet sander built in accordance with the present invention.

Referring now to the drawings, FIG. 1 shows a perspective view of a wet sander appliance generally designated by the numeral 10 and built in accordance with the present invention. The sander 10 includes a rigid, plastic hemispherical housing 11 which is conveniently shaped to fit in the hand of the user. The base of the hemispherical housing 11 is fixedly secured to a plate 12 which serves as a mounting for the fluid-driven nutating motor 13 (FIG. 2) of the sander. A flexible hose 14 passes through an opening 15 adjacent the base of the hemispherical housing 11 and connects the nutating motor 13 with a source of driving fluid, typically a water faucet or outlet 16.

Figure 2:
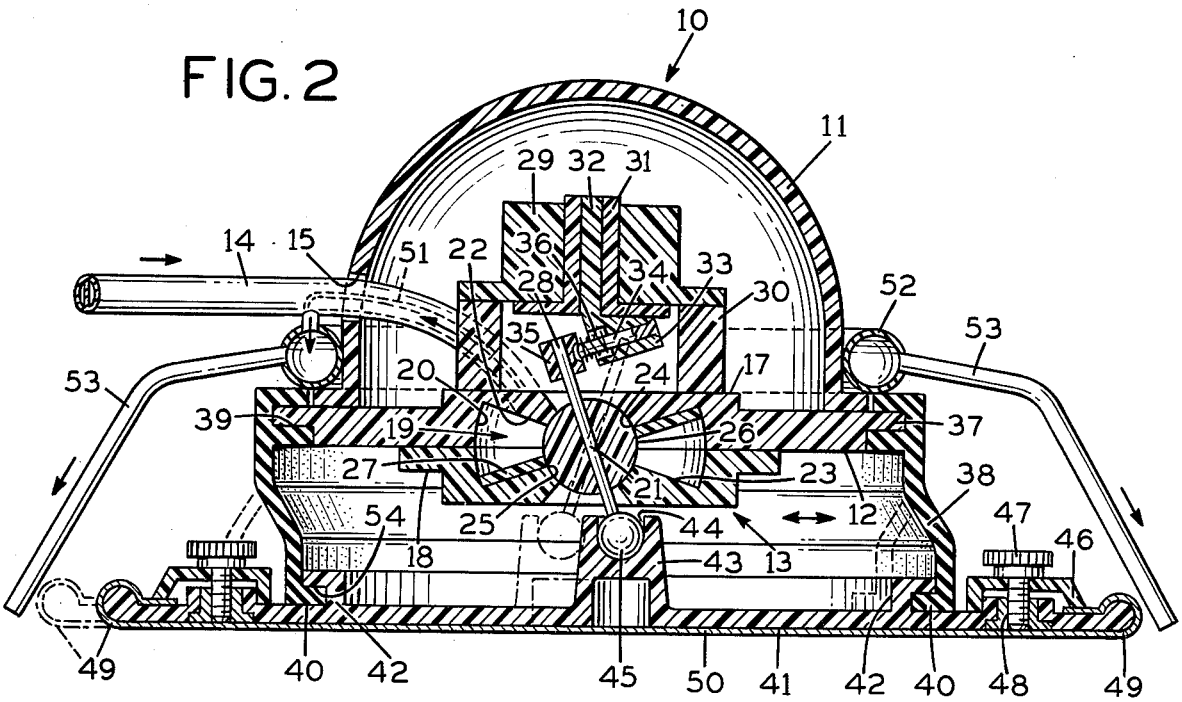
FIG. 2 is a side, cross-sectional view of the wet sander of FIG. 1.

As reflected in FIG. 2, the center portion of the plate 12 forms the upper section 17 of a motor housing. The lower section 18 is fixedly secured to the plate 12 as by an adhesive bond, and forms a chamber 19 with the upper section 17. The chamber 19 is, in general, a body of revolution, having side walls 20 of an arcuate configuration, whose center of curvature is at a central point 21 along the axis of revolution. The upper and lower walls 22, 23 of the chamber 19 are generally of a frustoconical configuration and are formed to terminate in opposed, spherically contoured bearing seats 24, 25.

In accordance wit known construction of nutating motors, a spherical bearing 26 is mounted for generally universal movement between the bearing seats 24, 25. The spherical bearing 26 has mounted thereon an annular disc or plate 27 which is aligned on a hemispherical plane passing through the center point 21. The sphere 26 and disc 27 form the wobble plate for the nutating motor 13. The wobble plate is tilted such that the upper surface of the disc 27 is in a tangential contact with the upper housing wall 22 and the lower face thereof is in tangential contact with the lower housing wall 23. An output element, in the form of a rod 28, extends through the spherical bearing 26 in perpendicular relation to the hemispherical plane of the disc 27. Each of the housing sections 17, 18 includes an opening at the bearing seats 24, 25 to permit the rod 28 to extend outside the nutating motor housing. A sufficiently close fit is provided between the spherical bearing 26 and its seats 24, 25 to reduce to a practical minimum leakage of the driving water from the bearing.

To maintain the tilt angle of the wobble plate, a yieldable bias arrangement is provided, constructed as follows: A cylindrical sleeve 29 is mounted in spaced relation to the plate 12, within the confines of the hemispherical housing 11, by a hollow, cylindrical spacer 30. The opening of the sleeve 29 is aligned with the axis of revolution passing through the center point 21. A bearing 31 is received within the sleeve 29 and rotatably supports a shaft 32 which extends into the interior of the spacer 30. The portion of the shaft 32 witin the confines of the spacer 30 is formed to an angularly-oriented block-like structure 33 which includes a longitudinally extending recess running generally parallel to the plane occupied by the tilted disc 27. An extension rod 34 is received within the block recess and is connected to the output rod 28 at the lower end thereof by a connector bearing 35. A spring 36 acts between the connector bearing 35 and block-like structure 33, and the extension rod 34 will therefore tend to hold the wobble plate at the desired tilt angle. In the event of a jam or overloading of the wobble plate, the output rod 28 can be displaced against the spring 36, permitting direct flow of driving fluid through the chamber 19 without displacement of the disc. This not only avoids potential damage to the nutating motor which might otherwise occur if a rigid connector existed between the output rod 28 and the angle enforcing device, but also enables the motor to be manufactured at much lower cost without sacrifice of performance—in fact with an improvement in performance.

The above-described and other advantageous arrangements for yieldably canting the wobble plate of a nutating motor form the subject matter of our co-pending application Ser. No. 888,136, filed Mar. 20, 1978.

Referring again to FIG. 2, the edge of the plate 12 is formed to include a rib 37. A rubber boot 38 is provided with an internal recess 39 formed at the upper end thereof and received over the rib 37 to support the boot 38 on the plate 12. The opposite end of the boot 38 includes an inwardly folded flange 40. In the preferred embodiment, the utilization device is a wet sander comprising a sanding pad 41 which includes a flange 42 of L-shaped cross-section. A slot 54 is formed between the flange 42 and sanding pad 41 and receives the flange 40 of the boot 38 to support the pad 41 in a spaced, parallel relation to the motor mounting plate 12. The boot 38 is formed of a rubber-like material which is sufficiently rigid in compression to maintain the spacing between the sanding pad 41 and plate 12 under normal working conditions. However, the boot 38 is sufficiently resilient in the transverse direction to allow the sanding pad 41 to be moved about orbitally within its plane, as reflected in the dashed line representation of the boot 38 and sanding pad 41 in FIG. 2.

In the illustrated form of the invention, the surface of the sanding pad 41 facing opposite the plate 12 includes an inwardly projecting circular block 43 at the center thereof. The circular block 43 terminates in a spherically contoured bearing seat 44. The output rod 28 of the nutating motor 13 includes a ball 45 which is seated in the bearing seat 44 to provide a direct drive coupling between the nutating motor 13 and sanding pad 41.

Running adjacent each of the ends of the sanding pad 41 is a clamping element 46 held against the pad 41 by thumb screws 47 which are received in threaded holes 48 formed in the pad 41. The edges of the pad 41 are finished to a rounded surface 49. A piece of sand paper 50 is placed over the outer surface of the sanding pad 41 and the ends thereof are rolled around the rounded surfaces 49 and clamped under the clamps 46 by turning down the thumb screws 47.

In accordance with known nutating motor construction, the disc 27 is provided at one side with an angular slot which straddles a dividing plate extending from the top to the bottom of the chamber 19 completely dividing the chamber 19. The size and configuration of the slot is such as to permit the wobble plate to move through a full range of tilting while preventing rotation thereof. In the operation of the device, water or other fluid under pressure enters the chamber 19 through the inlet line 14 at one side of the dividing plate. The water will flow in a counterclockwise direction through the annular passage formed by the motor housing parts 17, 18. The water will progressively displace the disc 27 and in accordance with known action of nutating motors the continuous inflow of water will result in a continuous, progressively rotary tilting action of the disc 27. This in turn will cause the ends of the output rod 29 to follow an orbital pattern without any rotary motion occurring. Thus, specific points at the ends of the output rod 28 will scribe a circle when the output rod 28 is activated by the nutating motor. This orbital action is translated directly to the sanding pad 41.

When the motive fluid has traveled completely around the chamber 19 to the opposite side of the dividing plate, it will flow out of the chamber through an exit tube 51 communicating with the chamber 19 and extending within the inlet tube 14 to a circular tube 52 mounted at the base of the hemispherical housing 11. Pursuant to the invention, pair of discharge tubes 53 are provided in flow communication with the circular tube 52 to direct the outflow of water onto the surface being sanded. This will provide a highly desirable flushing action for wet sanding and scrubbing.

The present invention provides a unique and highly advantageous form of hand-held sander or brush. The nutating motor contains only a few moving parts and is adaptable to low cost, high-volume manufacture, so as to be suitable for merchandising as a high sales volume appliance. The device may be constructed largely of precision molded plastic parts, which may be utilized substantially in the as-molded condition, without requiring costly machining or other finishing operations. This provides a lightweight, durable appliance that is much less tiring to use than conventional electrical appliances, which typically contain heavy motors, bearings, etc.

The possibility of a dangerous shock from an electrically powered sander when utilized in a wet environment has greatly inhibited effective wet sanding operations. Typically, a manual sanding operation must be performed when wet sanding is desired. The present invention, with a water powered motor, eliminates the electrical hazard and at the same time affords a readily available source of water for application to the working surface. Moreover, the wet sander of the present invention may be used for underwater sanding for boats, etc.

The advantageous direct coupling between the output rod 28 and sanding pad 41 transmits the orbital motion of the motor directly to the sanding pad 41, as the boot 38 yields in the transverse direction. This will provide a highly desirable sanding motion inasmuch as an orbital sanding motion is the easiest to use and control. Moreover, the direct coupling between the nutating motion and sander permits the motor itself to be of a simple, straightforward design.

It should be understood, of course, that the specific form of the invention herein illustrated and described is intended to be representative only, as certain changes may be made therein without departing from the clear teachings of the disclosure. For example, the utilization device may comprise a brush, abrasive pad, or other type of scrubbing or cleaning device and in some cases, air or any other suitable fluid may be utilized as the driving fluid for the nutating motion. Accordingly, reference should be made to the following appended claims in determining the full scope of the invention. Moreover, for the sake of completeness, and for a better understanding of the many potential advantages inherent in the invention, reference may be made to the beforementioned related co-pending applications.

We claim:

1. A fluid-driven positive displacement nutating action abrading-type appliance, which comprises (a) a motor housing, (b) a wobble plate mounted in said housing for universal tilting movement within predetermined limits, (c) means communicating with said housing providing for ingress and egress of fluid for driving said wobble plate, (d) an angularly disposed, orbitally movable rod-like output element carried by said wobble plate, (e) a support structure associated with said motor housing and being relatively rigid in vertical compression and relatively resilient in the transverse direction, (f) an abrading-type utilization device mounted by said support structure in spaced relation to said motor housing, and (g) means forming a direct universal coupling between said output rod and said utilization device whereby said utilization device is positively displaced through an orbital path while being restrained against rotation by said support structure.

2. The fluid-driven nutating action appliance according to claim 1, further characterized by (a) said support structure comprising a rubber, boot-like member secured at one end to said motor housing and supporting the utilization device at the opposite end thereof.

3. The fluid-driven nutating action appliance according to claim 2, further characterized by (a) said housing being mounted on said support structure on the side opposite the utilization device for use as a handle.

4. The fluid-driven nutating action appliance according to claim 1, further characterized by (a) said utilization device including a spherically contoured bearing seat and (b) one end of said output element including a spherical member seated in said bearing seat to form said universal coupling.

5. The fluid-driven nutating action appliance according to claim 4, further characterized by (a) said boot-like member surrounding and enclosing said universal coupling.

6. The fluid-driven nutating action appliance according to claim 2, further characterized by (a) said utilization device including a pad mounted to said opposite end of the boot-like member, (b) said universal coupling interconnecting said output rod and said pad whereby the pad is driven through an orbital path without rotation, and (c) clamping means associated with pad for securing a sheet of abrasive material.

7. The fluid-driven nutating action appliance according to claim 6, further characterized by (a) said means for egress of driving fluid comprising a tube communicating with said motor housing at one end thereof, and a discharge end directed at the working surface.

8. A fluid-driven nutating action appliance, which comprises (a) a nutating action motor having an angularly disposed orbitally movable output rod, (b) a utilization device, (c) an axially, relatively non-compressible, transversely relatively yieldable spacing element associated with said motor and utilization device whereby the utilization device is mounted in a normally fixed spaced relation to said motor in the axial direction while being movable within its plane relative to the motor, and (d) universal mechanical coupling means forming a direct connection between said output rod and said utilization device for positive displacement of said utilization device, (e) said utilization device being orbitally movable while being held against rotation by said yieldable spacing element.

9. The fluid-driven nutating action appliance of claim 8, further characterized by (a) said output rod extending between the motor and utilization device within the confines of said spacing element.

10. A wet abrading device comprising, (a) a liquid-driven nutating motor having a housing and an angularly disposed, rod-like orbitally moving output element, (b) an abrading pad connected to and driven orbitally and with positive displacement by said output element, (c) means coupling said abrading pad to said motor housing to accommodate orbital movement of the pad without rotation thereof, (d) said coupling means comprising a resilient boot-like element extending between and connecting the motor housing and the abrading pad, (e) universal drive coupling means drivingly connecting said output element to said abrading pad, and (f) said boot-like element surrounding and enclosing said coupling means and supporting said abrading pad in spaced, non-rotating relation to said motor housing, (g) inlet and outlet lines for driving fluid, (h) said inlet line being adapted for connection with a source of liquid under pressure, and (i) said outlet line being arranged to discharge at least a portion of the spent driving fluid in the vicinity of said abrading pad.

* * * * *